United States Patent [19]

Herrick

[11] Patent Number: 4,862,042

[45] Date of Patent: Aug. 29, 1989

[54] APPARATUS AND METHOD FOR FORMING SEGMENTED LUMINOSITY IN GAS DISCHARGE TUBES

[76] Inventor: Kennan C. Herrick, 2160 Mastlands Dr., Oakland, Calif. 94611

[21] Appl. No.: 37,423

[22] Filed: Apr. 13, 1987

Related U.S. Application Data

[63] Continuation-in-part of Ser. No. 727,810, Apr. 26, 1985, abandoned.

[51] Int. Cl.[4] ..... G05F 1/00

[52] U.S. Cl. ..... 315/291; 315/358; 315/174; 315/281

[58] Field of Search ..... 40/406, 407, 408, 544; 313/643, 672; 315/200 A, 291, 358, 248, 244, 219, 160

[56] References Cited

U.S. PATENT DOCUMENTS

| | | | |
|---|---|---|---|
| 1,939,903 | 12/1933 | Kayser | 315/281 X |
| 2,091,953 | 9/1937 | Becquemont | 315/358 |
| 2,214,441 | 9/1940 | Seaman et al. | 315/174 |
| 2,671,184 | 3/1954 | Kenty | 315/358 |
| 3,440,488 | 4/1969 | Skirvin | 315/291 |

*Primary Examiner*—David K. Moore
*Assistant Examiner*—Michael Razavi

[57] ABSTRACT

A device for producing and controlling the flow rate of bubble-like ionization discontinuities (30) in a gas discharge tube (10) which includes means to produce an alternating current at a frequency between 1500 and 8000 Hz and a voltage between 2000 and 12000 V (16), a capacitor (36) in series with the tube to prevent direct current flow through the tube, and means to produce asymmetry (18) between the positive portion and the negative portion of the alternating current through the tube, the asymmetry being time asymmetry or wave shape asymmetry, the degree of asymmetry influencing the rate of apparent bubble flow through the tube and the direction of asymmetry influencing the direction of the apparent bubble flow through the tube.

15 Claims, 4 Drawing Sheets

APPARATUS AND METHOD FOR FORMING SEGMENTED LUMINOSITY IN GAS DISCHARGE TUBES

CROSS REFERENCE

This application is a continuation-in-part of copending application Ser. No. 727,810 now abandoned, filed Apr. 26, 1985 and entitled APPARATUS AND METHOD FOR FORMING SEGMENTED LUMINOSITY IN GAS DISHARGE TUBES.

FIELD OF THE INVENTION

This invention is in the field of illuminated gas discharge tubes.

BACKGROUND OF THE INVENTION

Gas discharge tubes, such as familiar "neon" tubes, are widely used in signs, works of art and for illumination. Such tubes are made by evacuating the air from a glass tube and then introducing a selected gas such as neon inside the tube. The tube is sealed at each end around an electrode with external connection wires. Conventional neon tubes use ordinary 115VAC, 60 Hz electrical power. In order to provide enough voltage to ionize the gas, a current limiting type of transformer is employed to step up the 115V to the level of usually 2000V to 12000V, depending on tube length. The pressure of a gas in the tube is usually from about 1 to about 15 mm Hg. Instead of neon, the tube may contain other noble gases, mercury vapor of other suitable known gases or gas mixtures, and the tube may be transparent, translucent or internally coated with a material that fluoresces when subjected to the radiation of the gas discharge. Different gases and coatings produce different colors and intensities of light. Most of the familiar gas discharge tubes produce a steady continuous line of illumination along their lengths.

It is known, as disclosed in Kayser U.S. Pat. No. 1,939,903, that a gas discharge tube can be operated to produce illumination that starts at one electrode and appears to grow from that electrode through the tube and toward the other electrode. This effect is obtained by adjusting the frequency or voltage, or both, of the exciting current. The Kayser patent also discloses that the tuning element, disclosed to be a variable condenser, can be adjusted so that the illumination in the tube has a "bead and nodule" effect and that fine tuning of the condenser can cause the beads to move in one direction or the other through the tube, or can cause the beads to appear to remain stationary within the tube.

U.S. Pat. No. 2,091,953 issued to Becquemont discloses that discontinuous illumination of a gas discharge tube can be caused to move within the tube by superimposing a direct current on the alternating current that ionizes the gas. Other prior art such as Seaman et al. U.S. Pat. No. 2,121,829 and Skirvin U.S. Pat. No. 3,440,488 also disclose either processes for making the illuminated portion of the gas in a tube grow along the length of the tube to give the appearance of writing or to have dark spots move through an illuminated tube progressively from one end to the other.

Although it is known how to produce discontinuous illumination in a gas discharge tube and how to cause discontinuities, which have the appearance of bubbles to move one way or the other by superimposing direct current through the tube, there is great difficulty in regulating the movement of the discontinuities o bubbles. The motion of the bubbles is extremely sensitive to small changes in the direct current so that the apparent velocity of bubble movement or even the direction of bubble movement will change drastically if a small change in applied direct current flow occurs.

The electrical energy driving a gas discharge tube is susceptible to many small modifications. The energy coming from a power line varies somewhat in voltage from time to time during an ordinary day, there are seasonal and daily temperature variations that influence the circuit in which a gas discharge tube is operated and there are imperfections in the tube electrodes and in other portions of the circuit which will cause changes in the amount or quality of direct current in the circuit as a function of time or temperature. In fact, because electrodes are not identical any gas discharge tube will act to some extent as a rectifier, thereby producing its own direct current which will vary with time and changes in ambient temperature conditions. As a result, existing devices are not capable of maintaining bubble motion at a desired velocity and direction unless all electric conditions within the circuit affecting bubble motion are closely controlled.

SUMMARY OF THE INVENTION

This invention is an apparatus including a gas discharge tube in which the luminosity within the tube is segmented or discontinuous. The luminosity is in the form of a series of closely spaced segments with dark regions between them. The segments of luminosity have the appearance of illuminated bubbles in an otherwise dark tube.

This invention also includes means to cause the bubbles to move and to control their movement in order for them to move in either direction along the axis of the tube, or not to move and always occupy a fixed position in the tube, or to move in both directions from or toward a central part of the tube.

The invention includes an ordinary gas discharge tube fabricated by conventional mean and having within it a suitable gas or vapor at conventional pressure. The tube is operated by an AC power source having adequate electric potential to produce a discharge, means to produce an operating frequency from about 1500 to about 8000 Hz, means to produce and control an asymmetric waveform and means to eliminate direct current from flowing between the electrodes of the gas discharge tube. In general, smaller tube diameters require higher frequencies in the range to obtain the discontinuous or segmented luminosity.

Operation of the gas discharge tube at an appropriate frequency within the cited range produces bubbles. In order to render or maintain them visible as discrete luminous segments it is necessary to control their tendency to stream in one direction or the other. Rapid streaming causes the bubbles to be perceived as a continuous band of illumination. Controlling bubble movement is accomplished by adjusting the period- or amplitude-symmetry of the applied AC excitation waveform.

The bubbles are generally in the form of elongated oval-shaped segments which are slightly brighter at their ends and may have their middle portions slightly necked down. Ordinarily the bubbles are about twice as long as their diameters Their size is influenced by the frequency of the excitation energy and the diameter of the containing tube.

A preferred embodiment of the invention includes means to measure the velocity and direction of bubble travel and to use such measurement to control the asymmetry of the AC waveform in order to regulate bubble velocity. The invention also includes particular electric circuits for converting the waveform of AC line voltage to an asymmetric, square waveform including means to change the degree of asymmetry and to maintain the waveform at any selected degree of asymmetry. When the word asymmetry is used in this specification and the following claims it is intended to include a symmetric waveform, that is, a waveform with zero degree of asymmetry.

BEST MODE FOR CARRYING OUT THE INVENTION

Figure 1:
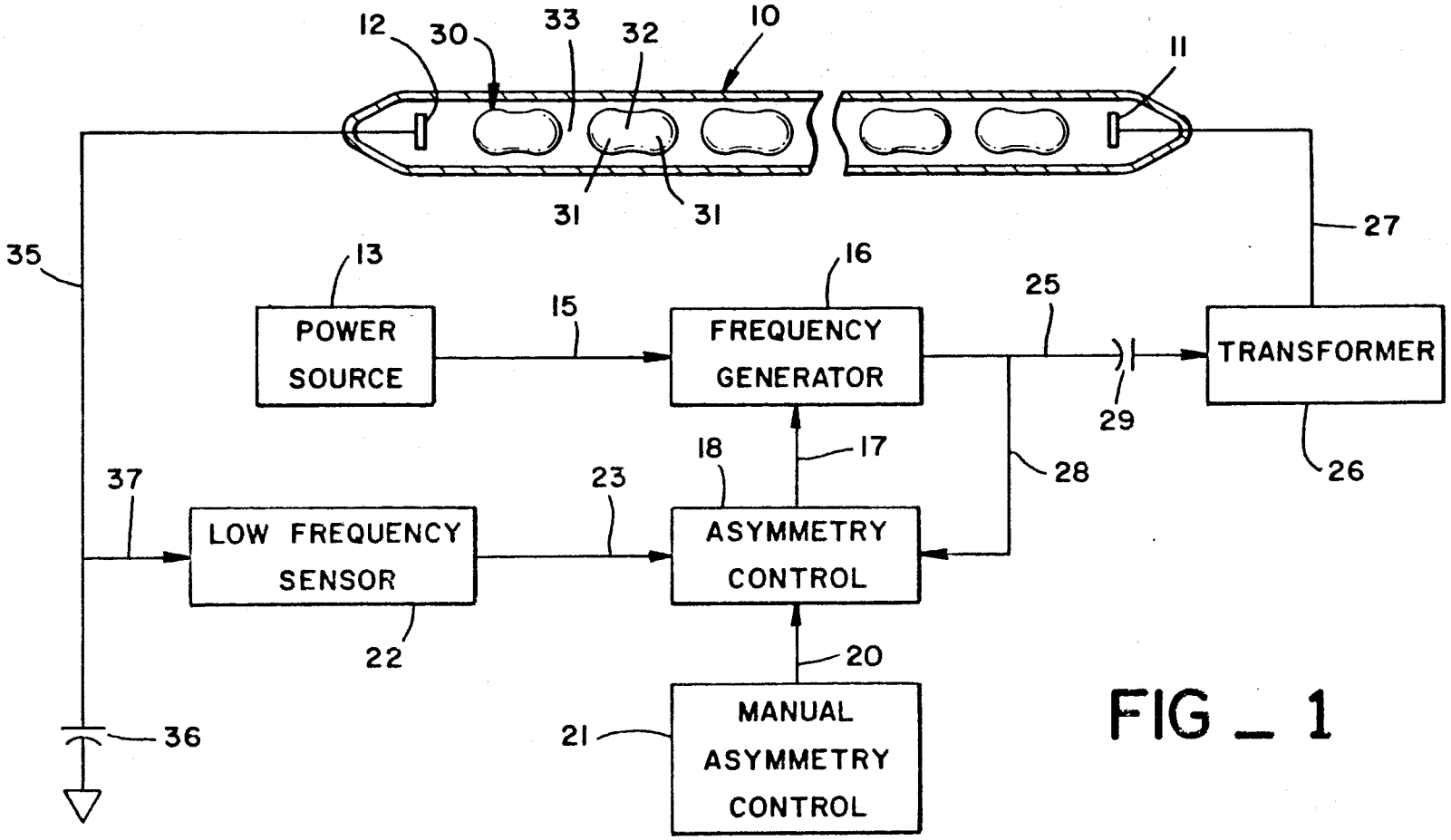
FIG. 1 is an electric circuit schematic and a partial view of a gas discharge tube embodying this invention.

The embodiment of the invention illustrated in FIG. 1 includes a gas discharge tube of indefinite length that is generally designated 10. The tube is provided with an electrode 11 and an electrode 12 which are located in opposite ends of the tube. The electrodes are hermetically sealed in the ends of the tube to make a gas-tight interior. The electrodes are placed in the tube which is then evacuated of air, raised to high temperature so as to evacuate impurities and then cooled and filled with a suitable gas, such as neon, at a pressure typically ranging between 1 and 15 mm Hg, after which the tube is sealed. The manner of making such tubes is well known.

An AC power source 13 is connected through lead 15 to a frequency generator 16. Frequency generator 16 is an electronic device that converts ordinary 60 Hz AC power to a preselected frequency in the range of 1500 to 8500 Hz. Frequency generator 16 is connected through lead 17 from an asymmetry control means 18 which regulates the asymmetry of the waveform generated in the frequency generator.

In the embodiment illustrated the asymmetry control means 18 may be influenced by other elements. One element is manual asymmetry control 21 which is connected through lead 20. When asymmetry control means 18 is adjusted it will produce a waveform with a preselected degree of asymmetry. The manual asymmetry control means 21 provides means to manually adjust the degree of asymmetry of the waveform as will be described in more detail hereinafter.

The asymmetry control means may also be influenced by a low frequency sensor 22 connected through lead 23 to the asymmetry control 18. The low frequency sensor may also influence the degree of asymmetry produced in control 18 as will be discussed hereafter.

Another influence on the asymmetry control means 18 is the output of frequency generator 16 conducted through lead 28 as input to asymmetry control 18. This input acts as a negative feed-back loop in a known manner to stabilize the degree of asymmetry established by the operation of the other elements involved in establishing frequency and asymmetry.

The output of frequency generator 16, as it is influenced by asymmetry control 18, is an alternating current having a frequency typically between 1500 and 8000 Hz and a controlled degree of asymmetry. The frequency generator is connected through lead 25 and capacitor 29 to a transformer 26 which steps up the voltage to that required to ionize the gas, usually in the range of 2000 to 12000 volts but retains the asymmetric waveform and frequency generated by the previously described means. Thus, lead 27 transmits high voltage alternating current with a waveform having controlled asymmetry to the electrode 11 and ionizes the gas in tube 10 to complete a circuit to electrode 12, through line 35 and capacitor 36 and to ground. Capacitor 36 eliminates DC current from the circuit that includes tube 10. Gas ionized with alternating current at the appropriate frequency and voltage will generate a series of illuminated discontinuities within tube 10 which are in the form of bubbles 30.

If the waveform of the AC current through tube 10 is symmetric the bubbles will be stationary with respect to the tube. If the waveform of the exciting alternating current is asymmetric the bubbles will move either toward electrode 11 or toward electrode 12 depending upon the sense of the asymmetry. When the waveform of the alternating current is more asymmetric the bubbles will move rapidly in one direction or the other. If the bubbles are moving from electrode 11 toward electrode 12 they appear to be growing out of electrode 11 and flowing into electrode 12. The bubbles, generally designated 30 are symmetric about their long axis and have a general dumbbell or peanut shape having ends 31 larger in diameter than a necked down central portion 32. The bubbles are separated by dark spaces 33 that are not illuminated and will take on the character of the background.

Electrode 12 is connected through lead 35 to capacitor 36 and ground. The capacitor 36 or its equivalent is necessary to eliminate the unpredictable effect of self generated DC tube current previously described, or any other DC current from flowing between electrodes 11 and 12. A lead 37 connects low frequency sensor 22 to lead 35.

In the operation of discharge tube 10 it has been found that when bubbles 30 move through the tube, each time a bubble 30 gives the appearance of disappearing into electrode 12 or of growing out of electrode 12 a small surge in the exciting AC current is generated. Thus, lead 35 may carry power at two AC frequencies. One frequency will be the frequency generated by generator 16 which will normally be between 1500 and 8000 Hz and the second frequency will be very low and will be the same as the number of bubbles apparently entering or apparently discharging from electrode 12 per unit of time. The latter frequency, hereinafter the low frequency, will normally be between about 1 and 10 cycles per second. The low frequency is a signal that may be used to measure the rate of bubble flow through tube 10 and changes in this frequency may be used to regulate asymmetry controller 18 to maintain constant velocity of the bubbles passing through tube 10. Thus, if asymmetry controller 18 creates a degree of asymmetry to establish a certain bubble velocity in a certain direction and, for reasons external to the circuit, the rate of flow tends to change with that degree of asymmetry, then low frequency sensor 22 can adjust the degree of asymmetry created by control 18 to reestablish movement of the bubbles at the desired preset velocity and direction.

Figure 2:
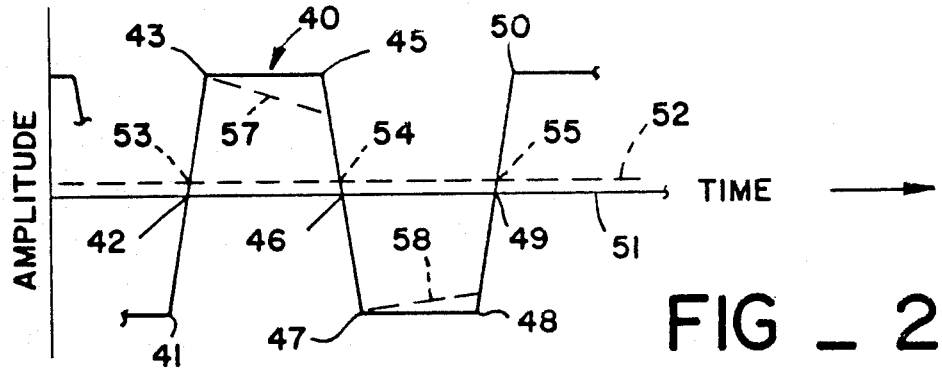
FIG. 2 illustrates particularly desirable waveforms useful in this invention.

FIG. 2 is a plot of amplitude versus time showing useful asymmetric waveforms for use in this invention. The AC current waveform illustrated in solid lines in FIG. 2 is called a square wave but it really is only nominally square. The trace of waveform 40, starting at point 41 rises substantially vertically to a point 43 and then moves substantially horizontally to a point 45 after which it moves substantially vertically downwardly to a point 47 and then substantially horizontally to a point 48 which is equivalent to point 41 for the next wave.

FIG. 2 illustrates to an exaggerated degree that the nominally vertical portions of trace 40 are not vertical but consume some space on the time axis. Thus, some time elapses between points 41 and 43 as is illustrated by the slope of the line between points 41 and 43. Time also elapses between points 45 and 47 and between points 48 and 50. Accordingly, the nominal square waveform is actually trapezoidal with the distance on the time axis between points 41 and 4 being greater than the distance on the time axis between points 43 and 45.

The line 51, hereinafter the base line, represents the line connecting all points at which the instantaneous current through tube 10 is zero. These points are represented in FIG. 2 as points 42, 46 and 49. Because of the known effects of transformer isolation and capacitive coupling by elements 26 and 36 of FIG. 1, the areas enclosed by trace 40 above and below base line 51 are equal. With identical waveform shapes above and below line 51, the distance between points 42 and 46 is equal to the distance between points 46 and 49. The waveform 40 illustrated in FIG. 2 is symmetric with respect to line 51 and it will produce standing bubbles; that is, bubbles that do not appear to move relative to the tube 10.

Figure 5:
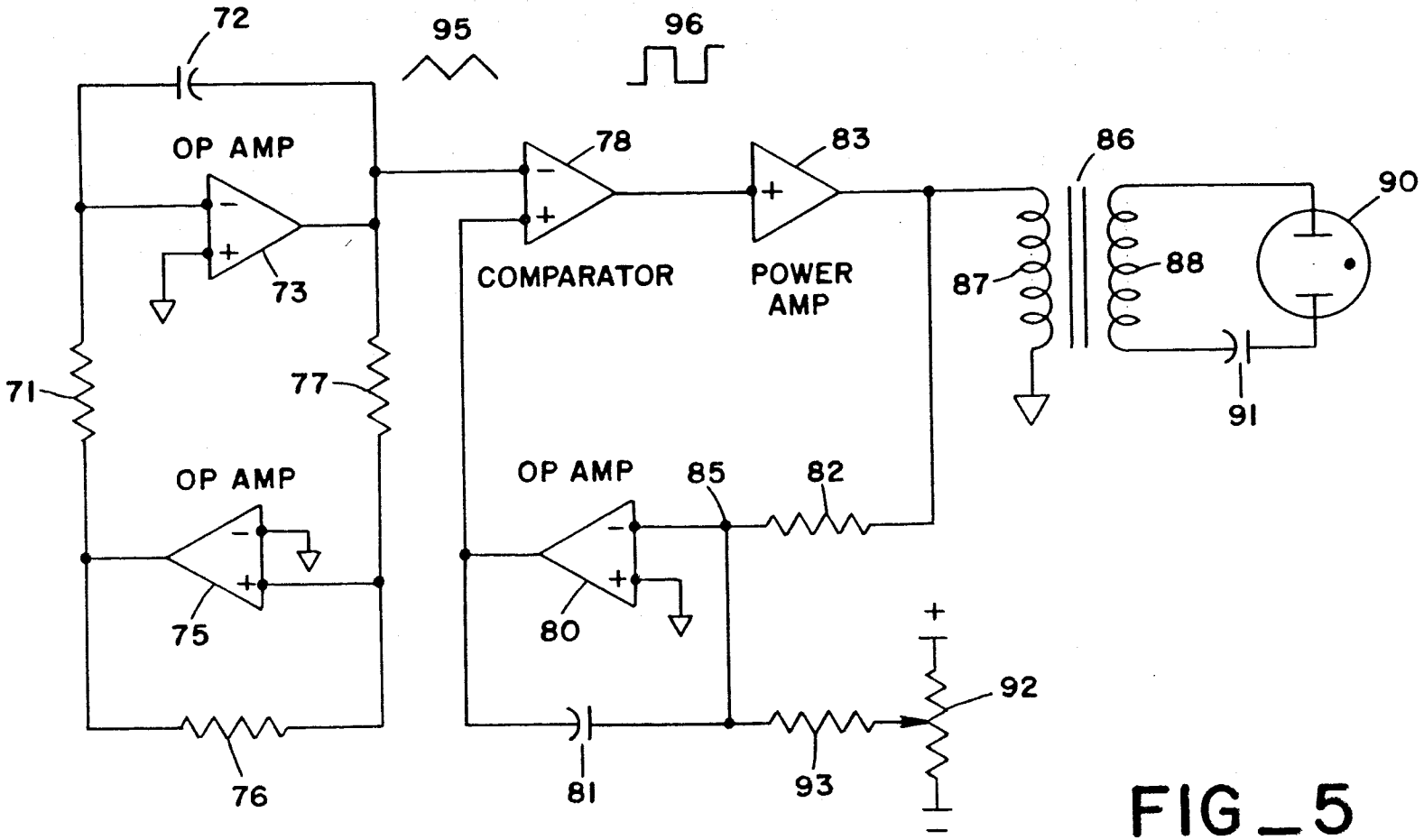
FIG. 5 is a schematic of a circuit embodying an asymmetry control useful in this invention.

If asymmetry controller 18 is operated to impose a control voltage on the frequency generator in a manner to change the time symmetry of the output wave of frequency generator 16 by making the time interval 42-to-46 different from interval 46-to-49, that asymmetry will be accurately coupled through capacitor 29 and transformer 26. The time asymmetry thus produced will cause bubbles 30 to move through tube 10 in one direction. If a different control voltage is imposed to make the timing of the intersection points more different, the bubbles will move more rapidly in that direction. If the opposite polarity of control voltage is imposed, the distances between intersection points 42, 46 and 49 will change oppositely and the direction bubbles 30 move through the tube will reverse. Control of bubble flow brought about by alteration of the time-symmetry of excitation wave 40 does not involve introducing DC current directly into the tube 40. FIG. 5, described hereinafter, illustrates a circuit that will generate a suitable excitation waveform, control its time symmetry and introduce a deliberate time asymmetry.

Another method of controlling asymmetry and thus bubble flow is to alter the shape of one half of the output wave of frequency generator 16 with respect to that of the other half while maintaining time symmetry at that point. Using this method and employing a substantially-rectangular wave from generator 16 such as the solid-lined wave 40, it is not effective merely to change the amplitude of one half of the wave with respect to some baseline voltage level; the effect at tube 10 will be to change the peak-to-peak amplitude of wave 40 while maintaining the baseline 51 exactly at the center of the wave as it was previously, thus not affecting bubble flow. Changing the shape of the top of the wave with respect to the shape of the bottom is, however, effective. Such a change is illustrated in FIG. 2 by "droops" in wave 40 as shown by broken line portion 57 and broken line portion 58.

Suppose that the top of wave 40 is given a droop downward and to the right as illustrated by 57 so that the area of the portion of the wave about the baseline 51 with respect to that below momentarily becomes smaller. This shape change if made within frequency generator 16 or even after capacitor 29, will be passed substantially unchanged to tube 10 but, in wave 40 as it appears at tube 10, the baseline must "shift" downward so as to equalize the two areas because of the DC-blocking effect of either capacitor 29 or transformer 26.

Figure 6:
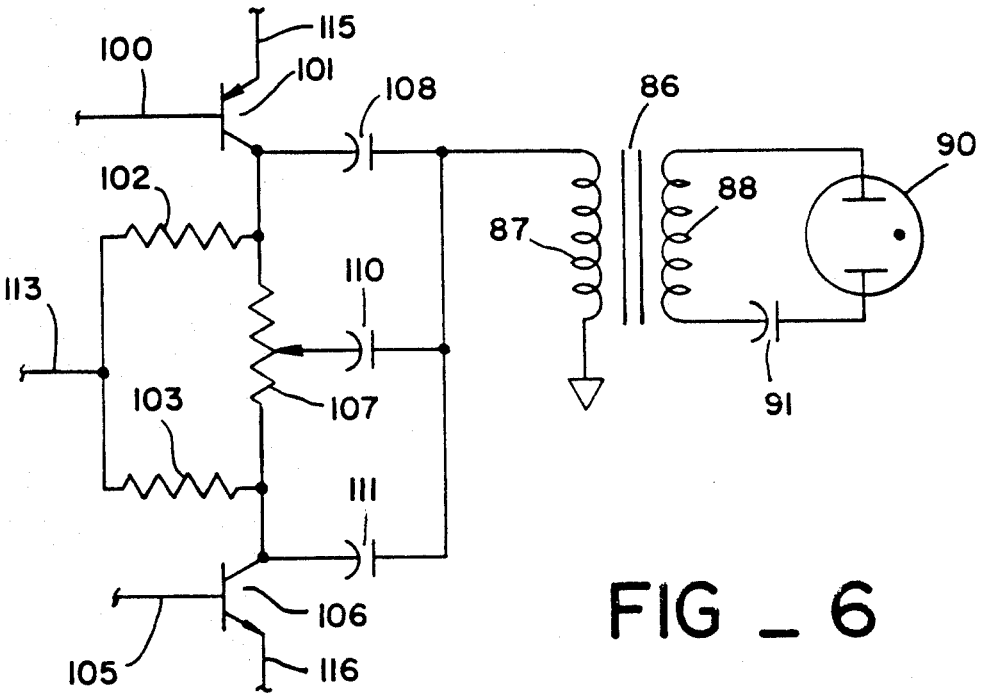
FIG. 6 is a schematic of another circuit embodying an asymmetry control useful in this invention.
Figure 7:
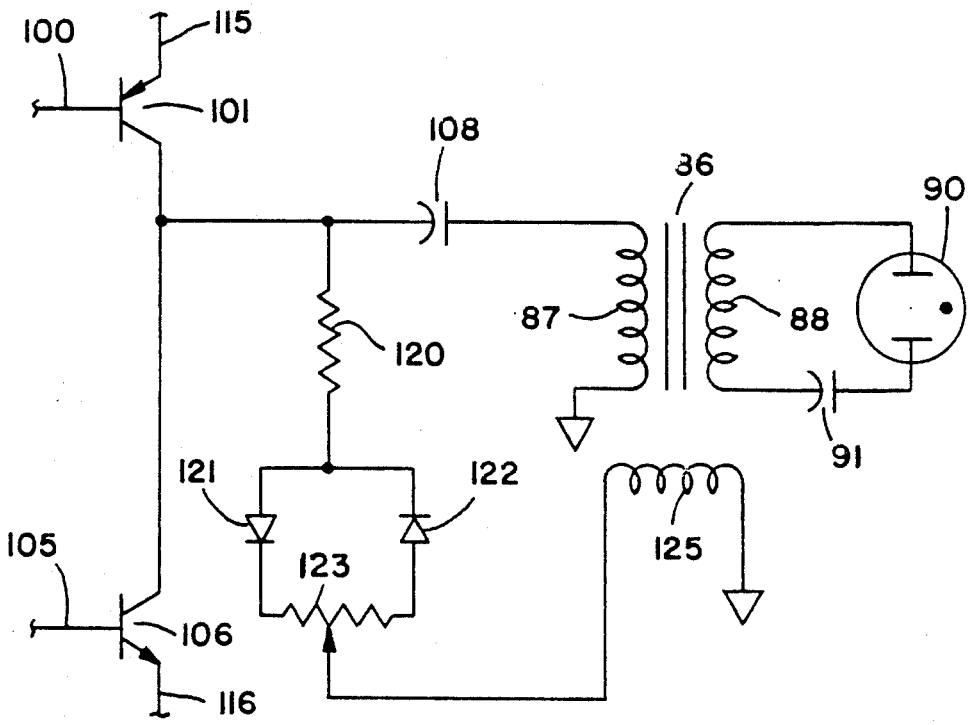
FIG. 7 is a schematic of another circuit embodying an asymmetry control useful in this invention.
Figure 8:
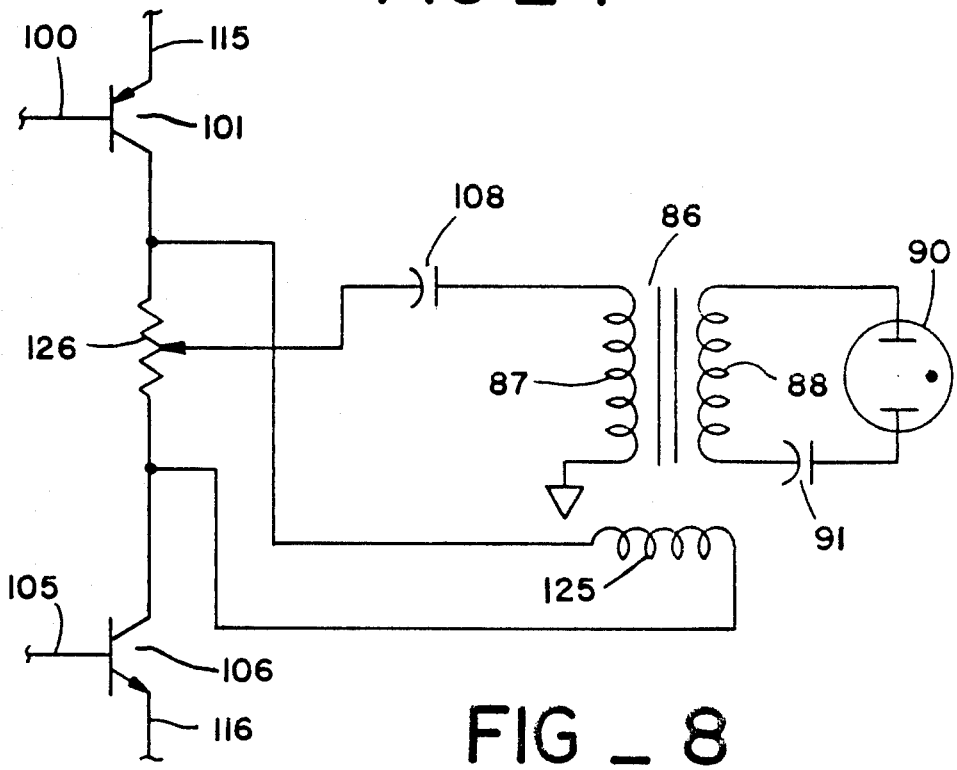
FIG. 8 is a schematic of another circuit embodying an asymmetry control useful in this invention.

Such shift of the baseline will, due to the slopes of the rising and falling edges of wave 15 as previously described, increase the time of interval 42-to-46 with respect to 46-to-49 and thus affect bubble flow. FIG. 6, described hereinafter, illustrates a circuit that will allow alteration of the relative shapes of the top and bottom output of frequency generator 16's. FIGS. 7 and 8 illustrate other circuits to accomplish the same end.

Figure 3:
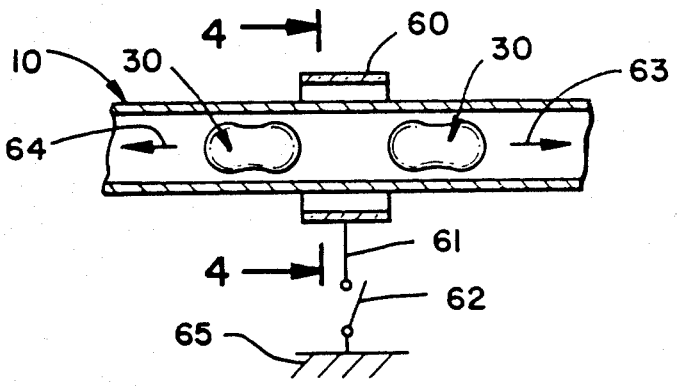
FIG. 3 is a cross-sectional, partial elevational view of a tube embodying another form of the invention.
Figure 4:
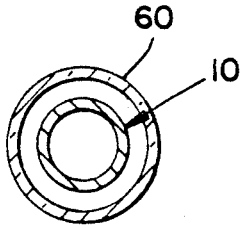
FIG. 4 is a cross-section taken along the line 4—4 of FIG. 3.

FIGS. 3 and 4 are partial illustrations of another embodiment of this invention. In FIG. 3, only the center part of tube 10 is shown. Tube 10 is connected as illustrated in FIG. 1. In the embodiment illustrated in FIGS. 3 and 4 there is a mid-tube current path in the form of a ring 65 made of electrically conductive material that surrounds tube 10 and is connected through lead 61 and switch 62 to ground 66 which may also be another electrical node that is electrically referenced to the AC power source. When the circuit including tube 10 is adjusted or built to produce a condition where bubbles 30 move neither to the left nor to the right, that balanced electrical condition can be changed by closing switch 62. The conducting ring 60 and the conducting gas within tube 10, separated by the glass wall of the tube, form a capacitance through which AC current will flow, causing bubbles 28 to flow in the direction of arrows 63 and 64, or in opposite directions. Thus, with the embodiment illustrated in FIGS. 3 and 4 bubbles can be made to flow in opposite directions appearing either to emanate from ring 60 and flow toward electrodes 11 and 12 or to emanate from electrodes 11 and 12 and flow toward ring 60. Instead of using an external ring and capacitive coupling an internal, auxiliary electrode may be used. This embodiment of the invention produces a striking effect that is useful in advertising or in art work involving gas discharge tubes. This embodiment of the invention may be used with any means for producing an asymmetric waveform.

FIG. 5 illustrates schematically a circuit useful for producing an excitation waveform for use in this invention and for controlling its time asymmetry.

In FIG. 5 operational amplifier 73, capacitor 72 and resistor 71 comprise an integrator while operational amplifier 75 and resistors 76 and 77 comprise a bistable circuit, all of these elements being combined to form a triangle wave oscillator which is known to the art. The triangle wave is essentially symmetrical about a ground base line and the waveform, illustrated as 95, is at the negative input of comparator 78. The output of comparator 78 is high when its positive input is more positive than its negative input, and it is low for the opposite condition.

If the output voltage of operation amplifier 80 is at or near zero a nominal square wave in the form shown at 96 is presented to the input of power amplifier 83. The square wave is fed to the transformer 86 by power amplifier 83 and it is in phase with the input of amplifier 83 and that wave is also connected to the input of the second integrator formed by operational amplifier 80, capacitor 81 and resistor 82. If the wave at resistor 82 has equal areas above and below the base line 51 as described in relationship to FIG. 2, the output voltage of the second integrator will be at some steady DC level. If the areas above and below base line 51 become unequal, the output voltage level of operational amplifier 80 will rise or fall at a rate that depends upon the degree of inequality. If the areas then become equal again the voltage will stay at the new level.

With triangular wave 95 applied to the negative input of comparator 78 and the variable DC level applied to its positive input, comparator 78 will produce at its output a rectangular wave such as wave 40 (FIG. 2), the duty cycle of which will depend upon the magnitude and polarity of the voltage at the positive input of comparator 78 with respect to the base line 51 of the triangular wave at its negative input. This signal constitutes the input to power amplifier 83. Thus, a negative feedback loop is created by the circuits of amplifier 78, 80 and 83. Any departure from perfect area symmetry of the wave applied to transformer 86 is negated by the output voltage of amplifier 80. That voltage will rise or fall a fraction of a volt about ground to effect a correction by negative feedback by appropriately altering in the opposite direction any asymmetry of the waveform 96.

Primary coil 87 of transformer 86 is grounded and secondary 88 of transformer 86 duplicates tee wave shape and frequency of the AC in coil 87; the effect of that wave shape and frequency influences the operation of discharge tube 90. Capacitor 91, of course, eliminates all direct current from the circuit including discharge tube 90 so that only the character of the alternating current from transformer 86 influences the character of the discharge through tube 90.

When the applied waveform is exactly symmetrical the bubble stream in discharge tube 90 appears to stand still. When it is desired to effect movement of the bubble stream a small external DC current may be introduced at node 85 as from potentiometer 92 through resistor 91. Such a current, as is known, requires an equal and opposite current to be supplied through resistor 82. An equal and opposite current in resistor 82, in the illustrated circuit, is produced by a slight asymmetry that is necessarily incorporated into the waveform at the output of amplifier 83 by the action of a negative feedback loop. Such asymmetry, as described above, will cause the bubble stream in discharge tube 90 to flow.

In a preferred embodiment of the circuit illustrated in FIG. 5, the circuit illustrated in FIG. 6 is incorporated into the output of power amplifier 83 and the extra current source through resistor 91 is eliminated. Although the output of the circuit of FIG. 5 is quite stable it is sensitive to variations in amplitude in the excitation wave due to power supply variations. If the bubbles in the tube are stationary because the time duration between 42 and 46 of wave 40 (FIG. 2) is the same as the time duration between 46 and 49, then variations in the amplitude of the excitation wave will make no difference in the stationary condition of the bubbles in tube 90. However, if the bubbles are moving in one direction or another, which characteristically is the result of those time durations being different, then variations in the amplitude of the excitation wave can make a small difference in the velocity of the bubbles in the tube. For example, if the peak-to-peak amplitude of the wave changes and the areas between the positive portion of the wave 40 and the negative portion become momentarily different, the base line 51 will shift slightly as illustrated by 52 to negate the difference. The result is that the ratio of the new time intervals between 53 and 54 and between 54 and 55 will be slightly different which in turn will change the velocity of the bubbles in tube 90.

The circuit illustrated in FIG. 6 essentially eliminates the undesirable effect described above and establishes a bubble flow rate not by altering the time symmetry of the waveform but rather by altering the relative shapes of the wave's extremes, that is the top and the bottom portions of the wave. An altered wave shape, as is known, will accurately be coupled through transformer 87 and capacitor 91 of FIG. 5 and will appear at tube 90. The circuit illustrated in FIG. 6 is added at the output node of amplifier 83 shown in FIG. 5. Line 113 connects to the node 85 instead of resistor 82 a illustrated in FIG. 5. Transistors 101 and 106 are typical of a suitable output circuit within amplifier 83, deriving their power from supply rails 115 and 116 and their drive signals from lines 100 and 105. The transistors ar alternately turned on and off so as to create a rail-to-rail nominally square wave signal. The signal output shown for amplifier 83 would normally be taken from the common collector node of the transistors, but in the circuit of FIG. 6 the collectors are separated and potentiometer 107 is inserted between them. From each collector the main signal coupling to transformer 86 is through equal value capacitors 108 and 111 and additional coupling is provided through the wiper of potentiometer 107 and through capacitor 110 which is substantially the same value, generally, as capacitors 108 and 111.

The capacitive coupling of a nominally square wave signal adds a "droop" to the high and low voltage levels of the wave as it appears at transformer 86. This is the droop represented by broken lines 57 and 58 in FIG. 2. With the wiper of the potentiometer at the center, this droop will be substantially equal both at the high and at the low level of the wave because capacitors 108 and 111 have equal values and the signal current delivered through capacitor 110 flows alternately through the equal value halves of potentiometer 107. However, when the wiper of potentiometer 107 is moved from the center more signal will be coupled from transistor 101 on the positive half cycles, or from transistor 106 on the negative half cycles, depending on the direction of movement. By this means, the amount of droop on the positive or on the negative half cycle can be made less than on the other half, thus causing the desired wave shape alteration.

To avoid influencing the time-symmetry feedback, resistor 82 of FIG. 5 is effectively split into two equal-value resistors 101 and 103 as shown in FIG. 6. One of these resistors is connected to each side of potentiometer 107 so that the fed-back signal (on line 113) is not influenced by the position of the wiper on potentiometer 107.

FIG. 7 and FIG. 8 illustrate two other circuits for altering the symmetry of the wave as illustrated in FIG. 2. The circuits illustrated in FIG. 7 and FIG. 8 also produce a "droop" in the upper and lower extent of the wave illustrated in FIG. 2. The circuits of FIG. 7 and FIG. 8 produce such a droop by influencing a magnetic shunt incorporated into the transformer 86. A shunt is normally included in a transformer used to drive a gas discharge tube.

In FIG. 7 the circuit, as in FIG. 6, is internal in the power amplifier 83 of FIG. 5. The circuit includes a supply rail 115 and a supply rail 116 between which are connected transistors 101 and 106, as explained above. A line including capacitor 108 connects to the primary coil 87 of the transformer 86 and from that line there is connected, through a current limiting resistor 120, oppositely connected diodes 121 and 122 between which potentiometer 123 is connected. Current from potentiometer 123 flows to winding 125 that encircles the magnetic shunt in transformer 86. With the potentiometer wiper at the center, the positive and negative currents through it and through diodes 121 and 122 are equal and pass through shunt winding 125 to cause an identical effect on the magnetic flux from that winding during both half cycles. When the potentiometer wiper is moved from center the current in one half cycle will be larger than that in the other. Added fluxes during the two half cycles will differ to affect unequally the transformer currents and produce a square wave at the transformer with a different droop for the positive half than it has for the negative half.

The circuit illustrated in FIG. 8 produces the same result in a different way. In the embodiment of FIG. 8 a potentiometer 126 is positioned in parallel with the control winding 105 whereby with the wiper of potentiometer 126 centered there will be equal current through the winding during both half cycles of the wave. When the wiper is not centered different current will flow during each half cycle so that the magnetic shunt will produce a different droop in the waveform for one half cycle than it will for the other in the manner previously described In every case, however, the circuit including gas discharge tube 90 will include no direct current because all such circuits include the capacitor 91 in series with gas discharge tube 90. Shunt coil 125 shown in FIGS. 7 and 8 may also be excited merely with a D.C. current of selectable magnitude and polarity, or even replaced by a permanent magnet, using known means. This will have the same effect on bubble flow as is described in connection with the circuits of FIGS. 7 and 8.

Relating the various drawings to FIG. 1, FIGS. 6, 7 and 8 are various embodiments of asymmetry control 18 or of manual asymmetry control 21 depending on how they are incorporated into a circuit. The portion of the circuit illustrated in FIG. 5 that includes operational amplifiers 73 and 75 and comparator 78 is a circuit capable of performing the function of the frequency generator 16 shown in FIG. 1 while the portion including operational amplifier 80 performs the function of asymmetry control 18.

The low frequency sensor of FIG. 1 may employ a lowpass filter of a known type or it may not connect to node 35 at all but rather may include a photo-electric cell positioned to sense alternating light and dark zones as bubbles flow past it. In either case the frequency sensed is fed back by known means to adjust asymmetry control 18 for a desired bubble flow rate.

What is claimed is:

1. In a device including a gas discharge tube having electrodes, an AC circuit including said electrodes and an AC power source connected to impose sufficient potential between said electrodes to ionize the gas in said tube to produce segmented luminosity, the improvement comprising:

first means to produce AC current through said tube at a frequency between 1500 and 8000 Hz, second means to eliminate direct current flow between said electrodes, and third means to regulate and modify the asymmetry of the wave pattern of said AC current flowing through said ionized gas without the application of direct current in order to control movement of luminous segments in said tube.

2. The device of claim 1 wherein said third means includes means to regulate the time asymmetry between the positive portion and the negative portion of said AC current.

3. The device of claim 2 wherein said means to regulate includes a comparator and an integrator in a negative feedback loop.

4. The device of claim 1 wherein said third means includes means to regulate the wave shape of the positive portion of said AC current wave and of the negative portion of said AC current wave.

5. The device of claim 4 wherein said third means includes a transformer having its secondary coil in circuit with said tube, having a magnetic shunt surrounded with a shunt coil and having means to vary the current through said shunt coil.

6. The device of claim 5 wherein said means to vary the current through said shunt coil includes a potentiometer connected differentially across said shunt coil.

7. The device of claim 6 wherein said potentiometer is in series with said shunt coil and connected differentially to two oppositely connected diodes.

8. The device of claim 4 wherein said third means includes a transformer having its secondary coil in circuit with said tube and having a magnetic shunt in magnetic circuit with a permanent magnet.

9. The device of claim 1 wherein said second means is a capacitor.

10. The device of claim 1 including a midtube current path.

11. The device of claim 10 wherein said midtube current path is an electrically conductive element in capacitive coupling with the gas in said tube and electrically connected with a reference potential.

12. The device of claim 11 wherein said reference potential is ground.

13. The device of claim 1 wherein said third means includes means to measure the apparent movement of said segmented luminosity in said tube.

14. The device of claim 13 wherein said means to measure includes a photoelectric cell.

15. The device of claim 14 wherein said means to measure includes a circuit responsive to a low-frequency current component in the electrode circuit of said tube.

* * * * *

UNITED STATES PATENT AND TRADEMARK OFFICE

CERTIFICATE OF CORRECTION

PATENT NO. : 4,862,042

DATED : August 29, 1989

INVENTOR(S) : Kennan C. Herrick

It is certified that error appears in the above-identified patent and that said Letters Patent is hereby corrected as shown below:

Column 1, line 68, "o" should be --or--.

Column 2, line 41, "mean" should be --means--.

Column 5, line 27, "4" should be --47--.

Column 7, line 39, "tee" should be --the--.

Column 8, line 28, "a" should be --as--.

Column 8, line 32, "ar" should be --are--.

Column 10, line 61, "14" should be --13--.

Signed and Sealed this

Twenty-fourth Day of July, 1990

*Attest:*

HARRY F. MANBECK, JR.

*Attesting Officer*

*Commissioner of Patents and Trademarks*